US006655813B1

(12) United States Patent
Ng

(10) Patent No.: US 6,655,813 B1
(45) Date of Patent: Dec. 2, 2003

(54) MULTI-FUNCTION LUMINAIRE

(75) Inventor: Sherman Ng, South Dartmouth, MA (US)

(73) Assignee: Genlyte Thomas Group LLC, Louisville, KY (US)

( * ) Notice: Subject to any disclaimer, the term of this patent is extended or adjusted under 35 U.S.C. 154(b) by 35 days.

(21) Appl. No.: 10/040,793

(22) Filed: Jan. 7, 2002

(51) Int. Cl.[7] ..... F21S 8/00

(52) U.S. Cl. ..... 362/148; 362/147; 362/150; 362/364; 362/365; 362/298; 362/299; 362/282

(58) Field of Search ..... 362/147, 148, 362/150, 364, 365, 298, 299, 282, 277, 293

(56) References Cited

U.S. PATENT DOCUMENTS 5,826,970 A * 10/1998 Keller et al. ..... 362/147
5,977,694 A * 11/1999 McGuire ..... 313/110
6,095,671 A * 8/2000 Hutain ..... 362/373
6,283,430 B1 * 9/2001 Schubert et al. ..... 248/343
6,478,453 B2 * 11/2002 Lammers et al. ..... 362/294

* cited by examiner

*Primary Examiner*—Sandra O'Shea
*Assistant Examiner*—Mark Tsidulko
(74) *Attorney, Agent, or Firm*—Jeffrey A. Haeberlin; Charles G. Lamb; Middleton Reutlinger

(57) ABSTRACT

A recessed light fixture includes a housing, a cap affixed to an upper edge of the housing, and a cover plate having an aperture formed therein and affixed to a lower edge of the housing. A junction box and transformer having associated wiring are affixed to the cap. Mounted within the housing of the recessed light fixture is a reflector having opposing first and second reflector surfaces, a first end, a second end, and a prism having at least one diverging lens. The prism is slidingly moveable within the second end of the reflector. A bulb is electrically connected to the transformer and mounted within the housing and protruding through an opening in the first end and thereby into an upper portion of the reflector. The first and second reflector surfaces are formed having a preselected parabolic geometry so that a light beam is narrowest at a preselected limit of travel of the prism closest to the bulb, and widest at a preselected limit of travel of the prism farthest away from the bulb.

16 Claims, 3 Drawing Sheets

MULTI-FUNCTION LUMINAIRE

BACKGROUND OF THE INVENTION

1. Technical Field

This invention relates to lighting fixtures and particularly to a recessed light fixture utilizing miniature optics together with opposing reflectors, a movable bulb, and a movable prism with lens.

2. Description of Relevant Art

Current light fixtures are often installed in ceilings to provide room illumination. When such fixtures are flush-mounted, they can lend an undesirable appearance of a ceiling filled with holes. Additionally, current fixtures often emanate undesirable light from integral reflectors when viewed from directly below, or otherwise directly on-axis with a projected beam of light. Current light fixtures are undesirably bulky in appearance when used in conjunction with modern room furnishings and appliances, which are chosen for a minimalist appearance in room decor. This is true even when such fixtures are flush-mounted, and in such cases, it is especially true for their reflector apertures. Thus, there is a need for a light fixture which is compact in size, uses miniature components to minimize the appearance of a reflector aperture, can be mounted in a ceiling, wall, or floor, offers an adjustable output light beam, shields the eyes of room occupants from reflector reflections, and is simple and easy to install and adjust.

SUMMARY OF THE INVENTION

It is an object of the present invention to minimize the appearance of a reflector aperture of a light fixture.

It is another object of the present invention to provide a light fixture having miniature optics.

It is even another object of the present invention to provide a light fixture having an adjustable light output.

It is yet another object of the present invention to provide a light fixture having a fixed reflector with opposing first and second reflector surfaces and a moveable prism in order to adjust the output light beam from a narrow to a wide light pattern.

It is a further object of the present invention to provide a light fixture having a fixed reflector with opposing first and second reflector surfaces, a moveable prism, a moveable bulb, and which can be utilized in ceilings as a downlight, on walls as a wall washer, on floors, or a framing projector.

More particularly, this invention relates to a recessed light fixture utilizing miniature optics together with a fixed reflector with opposing first and second reflector surfaces, a moveable prism having one or more diverging lenses, and a moveable bulb. The prism and bulb are moved independently, sequentially or simultaneously, in order to adjust an output beam of light ranging in width. In addition, the reflector is attached joined to the fixture, and the prism moves inside an end of the reflector in order to focus light into the prism. Likewise, the bulb is slidably mounted within a mounting bracket, so as to move nearer or farther from its proximity to the prism, as desired, in order to further achieve a preselected and desired range of focus. The adjustability feature of the prism allows the fixture to be utilized in applications including a downlight, a wall washer, a framing projector, or the like. In order to eliminate glare from within the fixture and particularly from the reflector, an aperture shield is affixed which adjustably covers a preselected portion of the aperture.

BRIEF DESCRIPTION OF THE DRAWINGS

A better understanding of the invention will be had upon reference to the following description in conjunction with the accompanying drawings in which like numerals refer to like parts throughout the several views and wherein.

DETAILED DESCRIPTION OF THE PREFERRED EMBODIMENT

Figure 1:
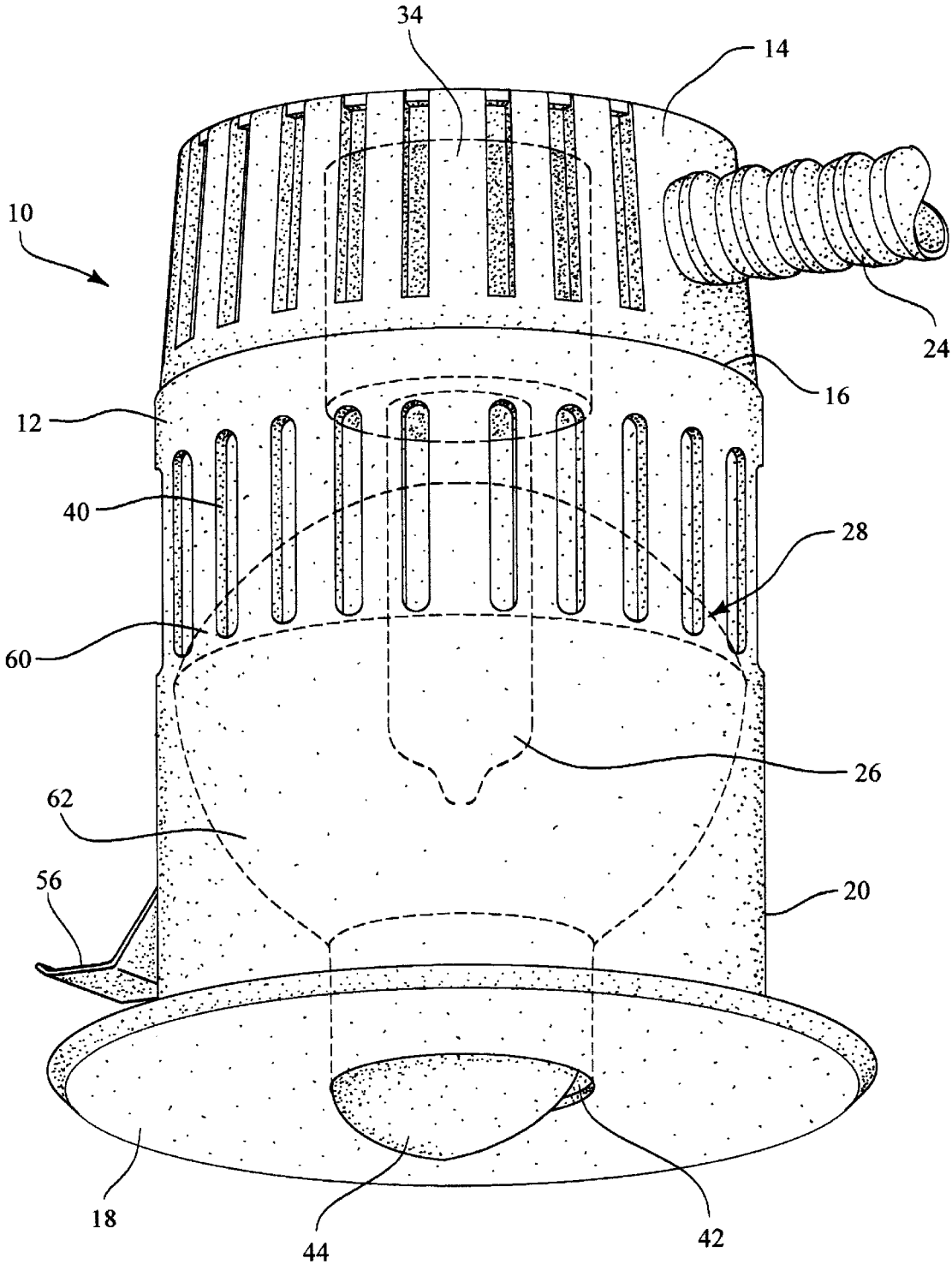
FIG. 1 is a perspective view of a recessed light fixture utilizing miniature optics of the present invention with selected features shown in phantom lines.

As shown in FIG. 1, a recessed light fixture 10 includes a housing 12, preferably substantially cylindrical in shape, having a cap 14 rotatably affixed to,an upper edge 16 thereof. A cover plate 18 is affixed to a lower edge 20 of the housing 12.

Figure 2:
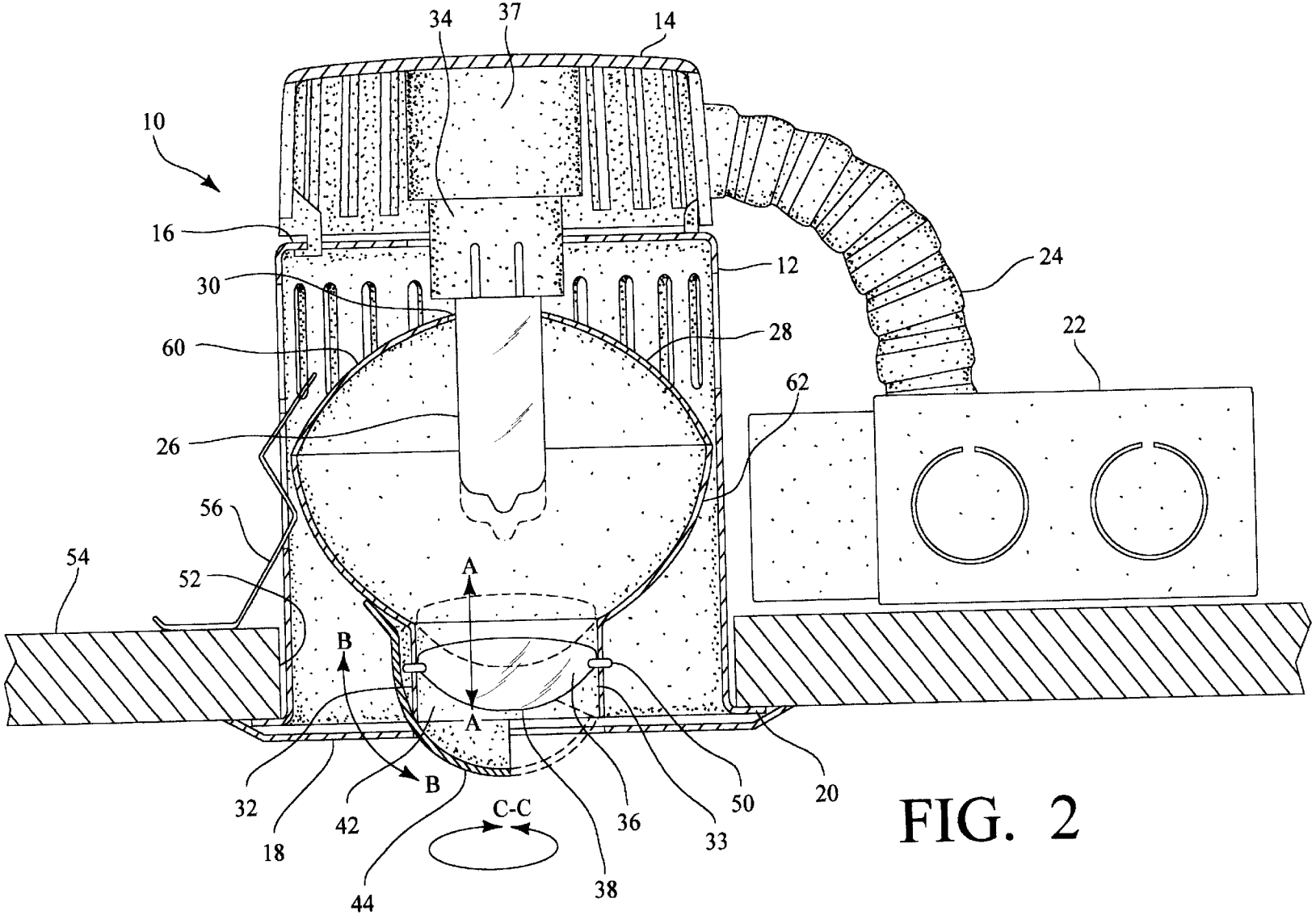
FIG. 2 is a sectional view of a recessed light fixture utilizing miniature optics of the present invention and including relevant details of the reflector and prism; and, FIG. 3 is a perspective view of another recessed light fixture utilizing miniature optics of the present invention with selected portions cut-away.

As shown in FIG. 2, a remote-mounted junction box and transformer 22 and associated flexible conduit wiring 24 are affixed to the cap 14 in order to supply electric current suitable to power a bulb 26 which is mounted within the housing 12.

With further reference to FIG. 2, light from bulb 26 is focused by use of a reflector 28 and a prism 36. The prism 36 includes at least one diverging lens 38. The reflector 28 has a first end 30 and a second end 32 and is affixed within the housing 12. One or more prism slots 33 are formed in the second end 32 to receive corresponding prism lugs 50 of the prism 36 which is adjustably affixed in the second end 32 along the axis depicted by line A—A. The reflector 28 includes opposing first and second reflector surfaces 60 and 62 with opposed first and second ends 30 and 32, respectively, which are substantially square in side profile view. A substantially parabolic or curve geometric profile is preselected for the reflector surfaces 60 and 62 of the reflector 28 in order to provide a desired range of focus of light emitted from the fixture 10 as the prism 36 is moved within the second end 32 of the fixture 10. The first end 30 is oriented underneath the cap 14 and surrounds a bulb upper portion 34 of the bulb 26. The bulb 26 is slidably mounted within a mounting bracket 37 in order to achieve even further adjustability of the pattern of light. The second end 30 is oriented just above the cover plate 18 and directly below the bulb 26.

Slots 40 are formed along the housing 14 as desired in order to allow heat to radiate away from the fixture 10 when in use.

An aperture 42 is formed along a central area of the cover plate 18 in order to allow light to radiate from the fixture 10. As desired, a rotational cap 44 is adjustably mounted and positioned within the aperture 42 in order to (1) direct a beam of light, and (2) shield light from striking preselected areas within a room or surface to be illuminated. The rotational cap 44 is rotated both vertically and horizontally as desired as depicted by lines B—B and C—C.

A preferred fixture 10 has an aperture 42 of a preselected size to accommodate bulbs 26 of varying diameters. And, the cover plate 18 is sized greater than the diameter of housing 12. Additionally, a preferred fixture 10 is modular in that, as desired, cover plates 18 are provided in differing preselected shapes and sizes and rotational caps 44 are provided or omitted as desired. As discussed above, the prism 36 is adjustably positioned within the fixture 10 and the bulb 26 is adjustably positioned within the mounting bracket 37. Thus, the bulb 26 is thereby also adjustably positioned relative to the housing 12 and cap 14. Preferably, preselected reflector 28 geometry allows the beam of light to be narrowest when the prism 36 and bulb 26 are in a position nearest to one another. Likewise, the beam of light is widest when the prism 36 and the bulb 26 are farthest away from one another. The reflector 28 is fixedly joined to the housing 12, and only the prism 36 and bulb 26 move in order to focus light into the prism 36. By use of fixtures 10 of the present invention, a beam of light is focused in width, as desired, from less than 1° to 180° degrees. This feature allows great versatility in mounting and use of fixtures 10 of the present invention.

The surfaces 60 and 62 of the preferred reflector 28 are high specular vacuum silver metalized. The prism 36 is clear or colored, as desired, in order to provide for decorative lighting. A preferred bulb 26 is a point-source bulb of halogen or tungsten-halogen and includes bulbs such as a 35-watt T-5 or T6 or smaller metal halide and 12-volt capsule LV or the like. Such miniaturized bulbs 26 act as a point-source beam of light for ease of focusing. Such bulbs 26 also aid in keeping the perceived size of the fixture down to an acceptable range to ensure consumer acceptance in decor and modern lighting situations.

The housing is preferably sheet-metal steel of a heat resistance black finish, and the cover plate 18 is preferably steel and in colors to include white or black; all as desired to match room decor.

In installation, the fixture 10 is mounted, as desired, in a variety of ways. An opening 52 of correspondingly diameter to the housing 12 is formed in a preselected mounting surface 54. The fixture 10 is then inserted into the opening 52 and retained in position by at least one hinged retaining tab 56 which is pivotably mounted in the housing 12. Springs (not shown) or mere bending of the hinged retaining tab 56 are used as desired in order to ensure that the fixture 10 does not slip out of the opening 52. As an aid to wiring and final installation, the cap 14 is affixed to the housing 12 by a twist-lock means such as helical threads (not shown), camming action, or the like.

When used as a ceiling down light, the fixture is oriented so that the beam of light illuminates a preselected area beneath the fixture 10. As discussed above, the prism 36 and bulb 26 are moved to focus the beam of light in a range from collimated to wide. As desired, the rotational cap 44 is fitted to provide more direction in the aiming of the beam of light. Likewise, the fixture 10 may be mounted in a floor to achieve similar benefits of illumination from a ground level.

When used as a wall washer, the use of the rotational cap 44 is desired in order to wash a wall with reflected light without a room occupant being subjected to objectionable direct illumination from within the fixture 10.

Figure 3:
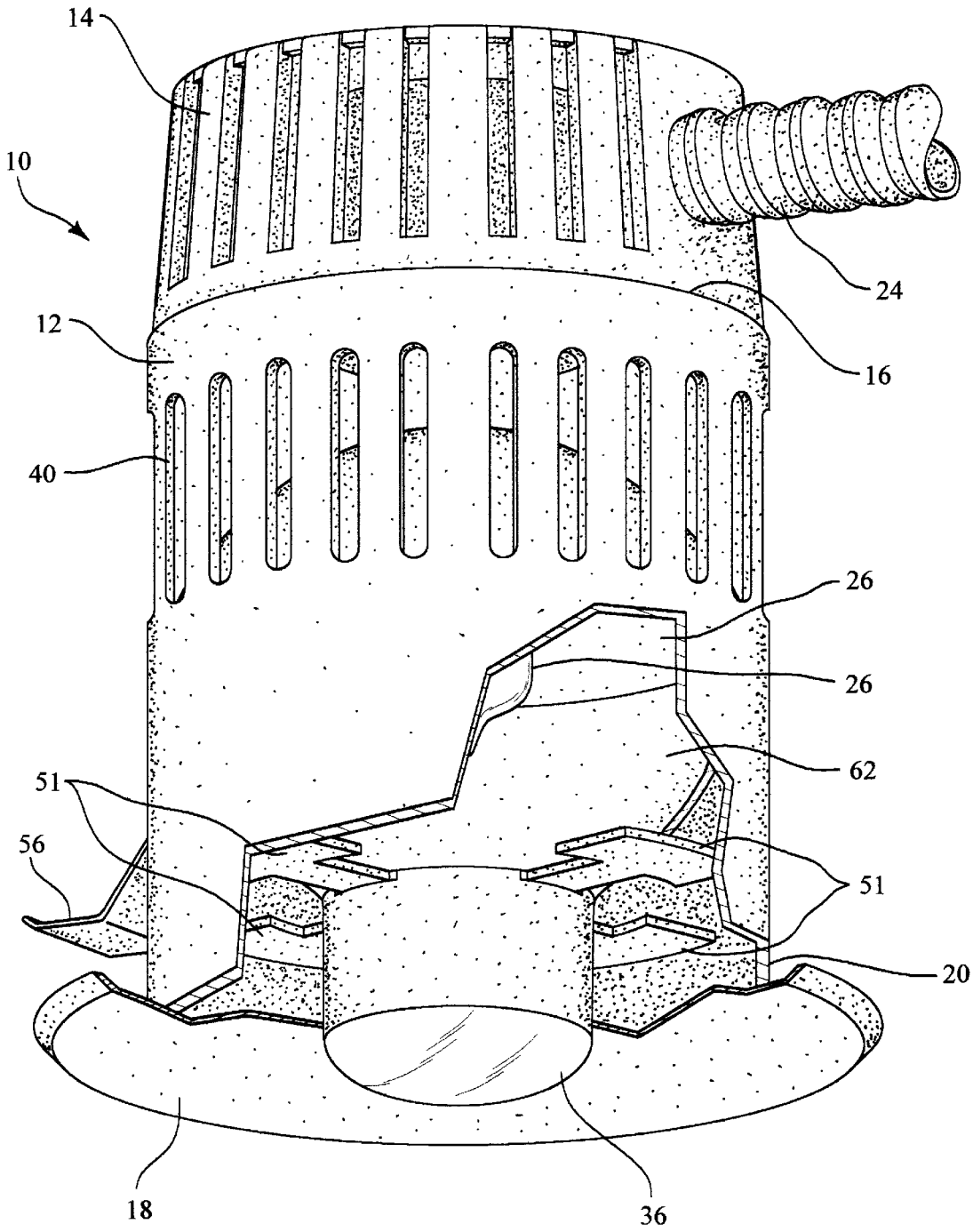

An alternative embodiment of a fixture 10 of the present invention is provided for use as a frame projector, as shown in FIG. 3. The fixture 10 is placed into a ceiling, floor or wall at a preselected distance in order to illuminate an object such as, for example, a painting, a poster, a print, or the like. When so used, it is desired to provide light only out to a perimeter of the object to be illuminated and not onto surfaces adjacent thereto. The framing projector fixture 10 of FIG. 3 shares the structure and features of light beam adjustability with the embodiment of FIGS. 1 and 2. Movement of the prism 36 and bulb 26 narrows the light beam. Baffles 51 are additionally provided in order to change a round light pattern to other geographic configurations, such as, for example, a square, a rectangle, an irregular polygonal shape, or the like. These other configurations are obtained by adjustment by the user in order to size the configuration or pattern to illuminate only the object to be illuminated and not the adjacent surfaces, as described above. The baffles 51 are movable and provided in four adjustably overlapping pieces, as shown in FIG. 3, or in a form similar to that of known photography camera irises (not shown). The physical location of the baffles 51 is preferably between the bulb 26 and the prism 36. The rotational cap 44 is again used as desired in order to illuminate the object to be illuminated without spreading the beam of light out to adjacent wall surfaces.

The foregoing detailed description is given primarily for clearness of understanding and no unnecessary limitations are to be understood therefrom for modifications will become obvious to those skilled in the art upon reading this disclosure and may be made without departing from the spirit of the invention and scope of the appended claims.

What is claimed:

1. A recessed light fixture comprising:

a housing;

a cap affixed to an upper edge of said housing;

a cover plate having an aperture formed thereon affixed to a lower edge of said housing;

a reflector having a first end and a second end mounted within said housing;

a prism including at least one lens adjustably mounted to said second end of said reflector, said prism of said reflector allowing a beam of light to be radiated in a preselected range of less than 1° to a 180° angle; and, a bulb adjustably mounted within said housing and protruding through an opening in said first end, said bulb extending into an upper portion of said reflector.

2. The recessed light fixture of claim 1 including a junction box and a transformer in electrical communication with said bulb.

3. The recessed light fixture of claim 1, said housing being substantially cylindrical.

4. The recessed light fixture of claim 1, said prism being slidingly moveable within said second end.

5. The recessed light fixture of claim 4, said reflector having opposing first and second reflector surfaces and preselected corresponding geometry so that a light beam is narrow at one limit of travel of said prism, and wide at an opposed limit of travel.

6. The recessed light fixture of claim 5, said reflector having opposing first and second reflector surfaces and preselected corresponding geometry so that a beam of light is narrowest at a preselected limit of travel of both said prism and said bulb, wherein said prism and said bulb are closest together, and widest at an opposite preselected limit of travel of both said prism and said bulb, wherein said prism and said bulb are farthest apart.

7. The recessed light fixture of claim 5, said first and second reflector surfaces having a preselected substantially curved geometric profile.

8. The recessed light fixture of claim 5, said first and second reflector surfaces being preselected high specular vacuum silver metalized.

9. The recessed light fixture of claim 1, said prism being clear.

10. The recessed light fixture of claim 1, said prism being of a preselected color.

11. The recessed light fixture of claim 1, said prism of said reflector having at least one diverging lens.

12. The recessed light fixture of claim 1, said housing having at least one slot formed therein.

13. The recessed light fixture of claim 1, said cap being adjustably affixed and rotatable both horizontally and vertically within said aperture.

14. The recessed light fixture of claim 1, said bulb providing a preselected point source beam of light.

15. The recessed light fixture of claim 11, said bulb being a miniature halogen or tungsten-halogen bulb to include a 35-watt T-5 or T6 metal halide and 12-volt capsule LV.

16. The recessed light fixture of claim 1, said housing being sheet-metal steel of a heat resistance black finish.

* * * * *

UNITED STATES PATENT AND TRADEMARK OFFICE

CERTIFICATE OF CORRECTION

PATENT NO. : 6,655,813 B1
DATED : December 2, 2003
INVENTOR(S) : Sherman Ng

It is certified that error appears in the above-identified patent and that said Letters Patent is hereby corrected as shown below:

Title page,
Item [56], References Cited, U.S. PATENT DOCUMENTS, add the following:

| | | |
|---|---|---|
| -- 1,618,055 | 02-15-1927 | Champeau, L.X. |
| 3,158,329 | 11-24-1964 | Wince, V.S. |
| 3,268,721 | 08-23-1966 | Dworkin, M., et al. |
| 4,475,147 | 10-02-1984 | Kristofek, P.J. |
| 4,519,021 | 05-21-1985 | Oram, J.A. |
| 4,745,533 | 05-17-1988 | Smerz, F.G. |
| 4,763,231 | 08-09-1988 | Houplain, G. |
| 4,916,579 | 04-10-1990 | Simms, R.A. |
| 5,567,034 | 10-22-1996 | Dietewich, H., et al. |
| 5,584,568 | 12-17-1996 | Corbasson, G., et al. -- |

Column 2,
Line 22, after “affixed to” delete “,”;

Signed and Sealed this

Thirtieth Day of March, 2004

JON W. DUDAS
*Acting Director of the United States Patent and Trademark Office*